166-273 SR
10/1/85 XR 4,544,206

United States Patent [19]
Wier et al.

[11] Patent Number: 4,544,206
[45] Date of Patent: Oct. 1, 1985

[54] SLUG-TYPE IN SITU RECOVERY OF MINERAL VALUES

[75] Inventors: Donald R. Wier, Bartlesville, Okla.; Gordon D. Gillham, Littleton, Colo.

[73] Assignee: Phillips Petroleum Company, Bartlesville, Okla.

[21] Appl. No.: 449,362

[22] Filed: Dec. 13, 1982

[51] Int. Cl.[4] ..... E21B 43/28
[52] U.S. Cl. ..... 299/4; 299/5; 166/273
[58] Field of Search ..... 299/4, 5; 166/273, 274

[56] References Cited

U.S. PATENT DOCUMENTS

| | | | |
|---|---|---|---|
| 3,332,482 | 7/1967 | McGhee | 166/274 |
| 3,618,664 | 11/1971 | Harvey | 166/274 |
| 3,811,505 | 5/1974 | Flournoy et al. | 166/274 |
| 3,882,940 | 5/1975 | Carlin | 166/273 |
| 3,893,511 | 7/1973 | Root | 166/305 R |
| 3,999,803 | 12/1976 | Coursen | 299/4 |

*Primary Examiner*—Stephen J. Novosad
*Assistant Examiner*—Mark J. DelSignore
*Attorney, Agent, or Firm*—C. F. Steininger

[57] ABSTRACT

Mineral values, particularly uranium, are recovered in situ from a heterogeneous subsurface earth formation containing the mineral values, which formation comprises zones of both high and low permeability, including injecting a plurality of separate slugs of leach solution adapted to solvate the mineral values into at least one injection well in communication with all zones of the formation, injecting a slug of a gas which is essentially insoluble in the leach solution between each two successive volumes of leach solution and withdrawing the pregnant leach solution, containing mineral values, from at least one production well in communication with all zones of the formation. The method can be further improved by injecting a mobility modifier, adapted to decrease the mobility of the leach solution, at the trailing end and/or leading end of the leach solution which is in contact with a slug of the gas. In a preferred embodiment, the mineral values contain significant amounts of uranium.

4 Claims, 7 Drawing Figures

SLUG-TYPE IN SITU RECOVERY OF MINERAL VALUES

BACKGROUND OF THE INVENTION

The present invention relates to the extraction of mineral values from mineral-containing materials. In a more specific aspect, the present invention relates to the extraction of mineral values in situ from subsurface formations. In a still more specific aspect, the present invention relates to the extraction of uranium values in situ from subsurface formations containing uranium.

Numerous minerals are present in subsurface earth formations in very small quantities which make their recovery extremely difficult. However, in most instances, these minerals are also extremely valuable, thereby justifying efforts to recover the same. An example of one such mineral is uranium. However, numerous other valuable minerals, such as copper, nickel, molybdenum, rhenium, silver, selenium, vanadium, thorium, gold, rare earth metals, etc., are also present in small quantities in subsurface formations, alone and quite often associated with uranium. Consequently, the recovery of such minerals is fraught with essentially the same problems as the recovery of uranium and, in general, the same techniques for recovering uranium can also be utilized to recover such other mineral values, whether associated with uranium or occurring alone. Therefore, a discussion of the recovery of uranium will be appropriate for all such minerals.

Uranium occurs in a wide variety of subterranean strata such as granites and granitic deposits, pegmatites and pegmatite dikes and veins, and sedimentary strata such as sandstones, unconsolidated sands, limestones, etc. However, very few subterranean deposits have a high concentration of uranium. For example, most uranium-containing deposits contain from about 0.01 to 1 weight percent uranium, expressed as $U_3O_8$ as is conventional practice in the art. Few ores contain more than about 1 percent uranium and deposits containing below about 0.1 percent uranium are considered so poor as to be currently uneconomical to recover unless other mineral values, such as vanadium, gold and the like, can be simultaneously recovered.

There are several known techniques for extracting uranium values from uranium-containing materials. One common technique is roasting of the ore, usually in the presence of a combustion supporting gas, such as air or oxygen, and recovering the uranium from the resultant ash. However, the present invention is directed to the extraction of uranium values by the utilization of aqueous leaching solutions. There are two common leaching techniques for recovering uranium values, which depend primarily upon the accessibility and size of the subterranean deposit. To the extent that the deposit containing the uranium is accessible by conventional mining means and is of sufficient size to economically justify conventional mining, the ore is mined, ground to increase the contact area between the uranium values in the ore and the leach solution, usually less than about 14 mesh but in some cases, such as limestones, to nominally less than 325 mesh, and contacted with an aqueous leach solution for a time sufficient to obtain maximum extraction of the uranium values. On the other hand, where the uranium-containing deposit is inaccessible or is too small to justify conventional mining, the aqueous leach solution is injected into the subsurface formation through at least one injection well penetrating the deposit, maintained in contact with the uranium-containing deposit for a time sufficient to extract the uranium values and the leach solution containing the uranium, usually referred to as a "pregnant" solution, is produced through at least one production well penetrating the deposit. The present invention is directed to the latter, "in situ" leaching.

The most common aqueous leach solutions are either aqueous acidic solutions, such as sulfuric acid solutions, or aqueous alkaline solutions, such as sodium carbonate and/or bicarbonate.

Aqueous acidic solutions are normally quite effective in the extraction of uranium values. However, aqueous acidic solutions generally cannot be utilized to extract uranium values from ore or in situ from deposits containing high concentrations of acid-consuming gangue, such as limestone. Aqueous alkaline leach solutions are applicable to all types of uranium-containing materials and are less expensive than acids.

The uranium values are conventionally recovered from acidic leach solutions by techniques well known in the mining art, such as direct precipitation, selective ion exchange, liquid extraction, etc. Similarly, pregnant alkaline leach solutions may be treated to recover the uranium values by contact with ion exchange resins, precipitation, as by adding sodium hydroxide to increase the pH of the solution to about 12, etc.

As described to this point, the extraction of uranium values is dependent to some extent upon the economics of mining versus in situ extraction and the relative costs of acidic leach solutions versus alkaline leach solutions. However, this is an oversimplification, to the extent that only uranium in its hexavalent state can be extracted in either acidic or alkaline leach solutions. While some uranium in its hexavalent state is present in ores and subterranean deposits, the vast majority of the uranium is present in its valence states lower than the hexavalent state. For example, uranium minerals are generally present in the form of uraninite, a natural oxide of uranium in a variety of forms such as $UO_2$, $UO_3$, $UO.U_2O_3$ and mixed $U_3O_8(UO_2.2UO_3)$, the most prevalent variety of which is pitch blende containing about 55 to 75 percent of uranium as $UO_2$ and up to about 30 percent uranium as $UO_3$. Other forms in which uranium minerals are found include coffinite, carnotite, a hydrated vanadate of uranium and potassium having the formula $K_2(UO_2)_2(VO_4)_2.3H_2O$, and uranites which are mineral phosphates of uranium with copper or calcium, for example, uranite lime having the general formula $CaO.2UO_3.P_2O_5.8H_2O$. Consequently, in order to extract uranium values from subsurface deposits with aqueous acidic or aqueous alkaline leach solutions, it is necessary to oxidize the lower valence states of uranium to the soluble, hexavalent state.

Combinations of acids and oxidants which have been suggested by the prior art include nitric acid, hydrochloric acid or sulfuric acid, particularly sulfuric acid, in combination with air, oxygen, sodium chlorate, potassium permanganate, hydrogen peroxide and magnesium dioxide, as oxidants. Alkaline leachants and oxidants or lixivants heretofore suggested include carbonates and/or bicarbonates of ammonium, sodium or potassium in combination with air, oxygen or hydrogen peroxide, as lixivants. However, sodium bicarbonate and/or carbonate have been used almost exclusively in actual practice.

While the previous discussion would indicate that "in situ" recovery of mineral values, such as uranium, is fairly simple and straight forward and would appear to be the best technique in most cases the very nature of subsurface formations containing mineral values and the types of formations in which such mineral values are found seriously complicate "in situ" recovery.

Quite often, subsurface formations containing mineral values are heterogeneous to the extent that the porosity varies considerably in a vertical direction thus having horizontally disposed zones of both high and low porosity, either in direct contact with one another or separated by layers of nonporous or impermeable formations. For obvious reasons, injection and production wells for in situ recovery of mineral values from such formations are completed so as to be in communication with the entire vertical dimension of the formation, rather than individual zones. Accordingly, the injected leach solution, which travels in a generally horizontal direction from the injection well or wells to the production well or wells will follow the path of least resistance, thus preferentially flowing through zones of high permeability with very little flowing through zones of low permeability. Accordingly, recovery of mineral values from zones of low permeability is very limited and in order to increase recovery from such zones of low permeability it is necessary to utilize excessive amounts of leach solution and substantially increase the time necessary for maximizing the recovery of mineral values.

SUMMARY OF THE INVENTION

It is, therefore, an object of the present invention to provide an improved method for recovering mineral values from materials containing the same which overcomes the above-mentioned and other problems of the prior art. A further object of the present invention is to provide an improved method for recovering mineral values from subsurface earth formations containing the same by "in situ" extraction. Another and further object of the present invention is to provide an improved method for the recovery of mineral values from subsurface earth formations containing the same wherein a leach solution adapted to solvate such mineral values is injected into subsurface formation and the leach solution containing significant amounts of mineral values is then withdrawn. A still further object of the present invention is to provide an improved method for the "in situ" leaching of mineral values from subsurface formations which significantly reduces the volume of leach solution required. Yet another object of the present invention is to provide an improved method of "in situ" leaching of mineral values from subsurface formations in which the subsurface formation contains zones of both high and low permeability. Another and further object of the present invention is to provide an improved process of in situ leaching of mineral values from subsurface formations in which the time required for the recovery of a predetermined amount of the mineral values is substantially reduced. Still another object of the present invention is to provide an improved method for recovering mineral values, particularly uranium, from subsurface formations in accordance with the above and other objects. These and other objects of the present invention will be apparent from the following description.

In accordance with the present invention, mineral values are recovered in situ from heterogeneous subsurface earth formations containing said mineral values, which formation comprises zones of both high and low permeability, including injecting a plurality of separate slugs of leach solution adapted to solvate the mineral values into at least one injection well in communication with all zones of the formation, injecting a slug of a gas, which is essentially immiscible with the leach solution between each two successive volumes of leach solution and withdrawing pregnant leach solution containing significant amounts of solvated mineral values from at least one production well in communication with all zones of the formation. In accordance with another embodiment of the present invention, a volume of mobility modifier adapted to decrease the mobility of the leach solution is injected into at least one of the trailing end and the leading end of each slug of the leach solution which is in contact with a slug of the gas.

DESCRIPTION OF THE PREFERRED EMBODIMENTS

Figure 1:
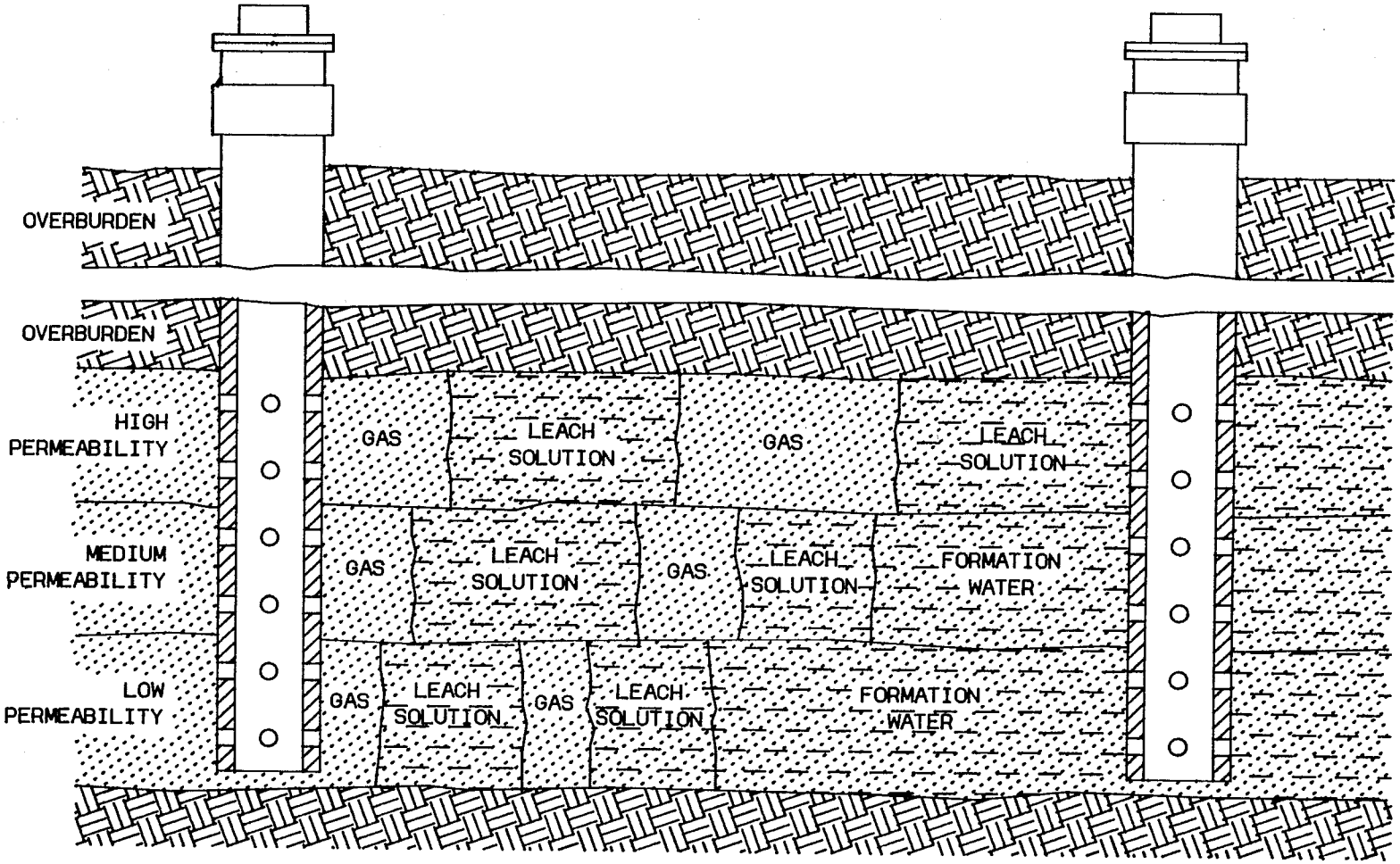
FIG. 1 schematically shows a subsurface formation and the relative volumes of leach solution and gas in various zones of the formation.

Briefly, the present invention relates to a method of recovering mineral values, particularly uranium, from subsurface earth formations having both high and low porosity or permeability zones in which a plurality of separate slugs of leach solution adapted to solvate the mineral values, such as the aqueous acidic, and alkaline leach solutions referred to in the introductory portion hereof, are injected into at least one injection well in communication with the formation, a slug of gas, which is essentially immiscible or insoluble in the leach solution, such as air or nitrogen, is injected between each two successive volumes of leach solution and pregnant leach solution containing solvated mineral values is withdrawn from at least one production well in communication with the formation. In accordance with another aspect of the present invention, a mobility modifier adapted to decrease the mobility of the leach solution is injected at the trailing end and/or the leading end of each slug of leach solution at the zone of contact between the leach solution and the gas. Preferred mobility modifiers are surfactants which tend to foam in the environment in which they are utilized and particularly surfactants which are resistant to or nonreactive with the components of the leach solution, particularly oxidants and acids or alkalis. As a result of the practice of the present invention, the volumetric sweep of the formation by the leach solution is substantially improved, the volume of leach solution required to recover a predetermined portion of the mineral values is substantially reduced and the time required to recover a predetermined amount of mineral values is substantially reduced.

Before discussing the present invention further, it is desirable to briefly discuss certain terminology to be employed. Since the terminology utilized in oil field operations and oil recovery from subsurface earth formations is the same as that employed in the recovery of mineral values, such as uranium, no distinction is made herein between such operations. As is well known in the art, the terms "pore volume" and "porosity" refer to the total volume of pores or void spaces in a core of a subsurface formation or a subsurface formation or zone. The pores of a subsurface formation may be interconnected, thus permitting the flow of fluids therefrom and therethrough or disconnected, thus essentially, preventing the flow of fluids therefrom or therethrough. A formation having interconnected pores is referred to as a "permeable" formation whereas one having disconnected pores is referred to as an "impermeable" formation. The permeability of a formation or core is an expression of ease of flow of a fluid through a formation having interconnected pores, or in essence, the rate of flow for a given area usually expressed in terms of millidarcies. "Specific permeability", as utilized herein, refers to single phase permeability or permeability where the formation is 100% saturated with water. On the other hand, "relative permeability" refers to the permeability to a given fluid, for example, water or gas in a reservoir in which the formation contains both water and gas. Therefore, when reference is made herein to zones of high porosity and zones of low porosity, it is assumed that the formation referred to is also permeable and permits significant flow of fluids therefrom or therethrough. There is a tendency in the art to refer to the terms, "miscible" or "immiscible" and the terms, "soluble" and "insoluble", alternatively. However, these terms should be considered mutually exclusive. For example, when a fluid is miscible or imiscible with another fluid, the two fluids either mix with one another or do not mix with one another and are not necessarily soluble or insoluble in one another. Consequently, it is preferred that the term, "miscible" be utilized to refer to the mixability of the two fluids in all proportions, as opposed to two fluids which do not mix under the conditions of operation. Hence the term, "partial miscibility", should be avoided. On the other hand, in order to avoid confusion and make a clear distinction between miscible and soluble, a fluid can be soluble in all proportions in another fluid, partially soluble in the other fluid or only slightly soluble in the other fluid.

As pointed out in the introductory portion hereof, when a formation contains zones of both high and low permeability injected leach solution will preferably flow through the zones of high permeability thus recovering little of the mineral values contained in the zones of low permeability unless excessive volumes of leach solution are employed and long periods of fluid injection are employed. Even under these conditions, little is gained since the permeability of the more porous formation to leach solution increases as the saturation of the more porous formation with leach solution increases. Thus, there is a cumulative effect which is detrimental to the recovery of mineral values. If, on the other hand, the volumes of leach solution flowing through the high permeability and the low permeability zones can be made as nearly equal as possible, the volumetric sweep of the formation will be substantially improved, the total volume of leach solution necessary for a given recovery can be reduced and the time required to recover a predetermined amount of mineral values is reduced. These objectives are accomplished in accordance with the present invention.

Leach solutions for the recovery of mineral values from subsurface formations are well known in the art, as pointed out in the introductory portion hereof and no further discussion thereof is deemed appropriate.

Gases to be utilized in accordance with the present invention are preferably essentially insoluble in the leach solution, since a high degree of solubility of the gas in the leach solution will simply dissipate the gas slug and neutralize its effect. High injection pressures are not normally utilized in the recovery of mineral values from a subsurface formation and such high pressures increase the cost of operation. It is desirable that the injection pressure be sufficiently low to render the gas immiscible in the leach solution. Under these conditions, an irreducibly gas saturation will exist behind the leach solution front and the gas resulting in reduced permeability to the leach solution which is highly desirable. On the basis of cost and availability, preferred gases for use in the present invention are air and nitrogen.

When mobility modifiers are utilized in accordance with the present invention, any of the known mobility modifiers in the art of oil field operations can be utilized. However, in order to take full advantage of the effectiveness of such mobility modifiers, it is preferred that the mobility modifier be one that is resistant to and is not chemically reactive with the components of the leach solution, such as acids or alkalis and oxidants. To the extent that a chemical reaction does occur, the mobility modifier will be degraded to an ineffective residue. For example, polymers are known to be effective mobility modifiers in oil field operations. However, oxidants and acids in a leach solution will render such polymers ineffective very rapidly. Therefore, preferably, surfactants are utilized in accordance with the present invention, particularly, surfactants which foam in the environment and under the conditions of operation. Such formation of foam thus increases the resistance to flow of the aqueous phase (leach solution) in a high saturation gas layer activity in an even greater degree than can be accomplished with gas and water alone. Particularly preferred surfactants are nonionic surfactants, for example, Igepal CO-530 (a trademark of Antara Chemical Company) which is a nonylphenoxy polyethanol having an average chain length of the hydrophilic end of about 6 to 6.5 moles or units of ethylene oxide. Other suitable materials include ethoxyalated and polyethoxyalated octyl phenol with about 10 moles of ethylene oxide, etc. Such surfactants are well known to those skilled in the art and can be readily selected for use under specific conditions.

The present invention will be better understood by reference to the drawings and the following description.

FIG. 1 shows schematically and qualitatively the relative amounts of leach solution going into a high permeability layer, a medium permeability layer and a lower permeability layer, for an ideal situation where vertical communication between the layers does not exist. However, this does not mean that such noncommunication is necessary. FIG. 1 thus shows that the relative amount of leach solution going into the tighter or less permeable zones is increased by the injection of slugs of gas between slugs of leach solution.

As previously pointed out, injected leach solution will tend to preferentially flow in a high permeability layer. In operation accordance with the present invention, once the uranium is leached from the high permeability zone, uranium production will fall off. At this point, a slug of relatively water insoluble gas, such as air, is injected. This gas will also flow predominantly into the high permeability layer. Injection of the aqueous leach solution can then be resumed and the sequence can be repeated. While it is not intended to limit the present invention to any particular theory, it is believed that after the slug of gas has preferentially entered the high permeability zone, the permeability to the next slug of leach solution will be reduced the most in the zone which previously took the most gas from the gas slug because of the gas-water relative permeability relationship. More specifically, as the water saturation of a formation increases, the permeability to water increases and the permeability to gas decreases and vice versa. This effect is believed to cause a greater percentage of the injected second slug of leach solution to enter the less permeable zones which have not theretofore received much of the leach solution. Thus, the process will divert leach solutions into the less permeable zones and increase uranium production and production rate.

In order to illustrate the results and advantages of the present invention, a series of experiments was carried out in which two cores, namely, a Boise outcrop core, having a high pore volume of 13.05 milliters, and a Berea outcrop core, having a pore volume of 9.77 milliters, and hence high and low permeabilities, respectively, were utilized in the series of flow experiments. While the cores utilized did not contain uranium and water was utilized instead of a leach solution, the results and advantages of this series of runs are equally applicable to uranium recovery. Fluids are injected into the cores in parallel, i.e., the fluid stream was split between two lines connected to the two respective cores so as to apply the same pressure to both cores and make the same fluid available for flow through both cores. The volume of fluids produced at the downstream end of each core and the time of collection were recorded. The cores were first saturated with a one percent calcium chloride solution to simulate reservoir conditions. Sufficient samples of the effluent were collected to be sure that the flow rate was constant in both cores.

Figure 2:
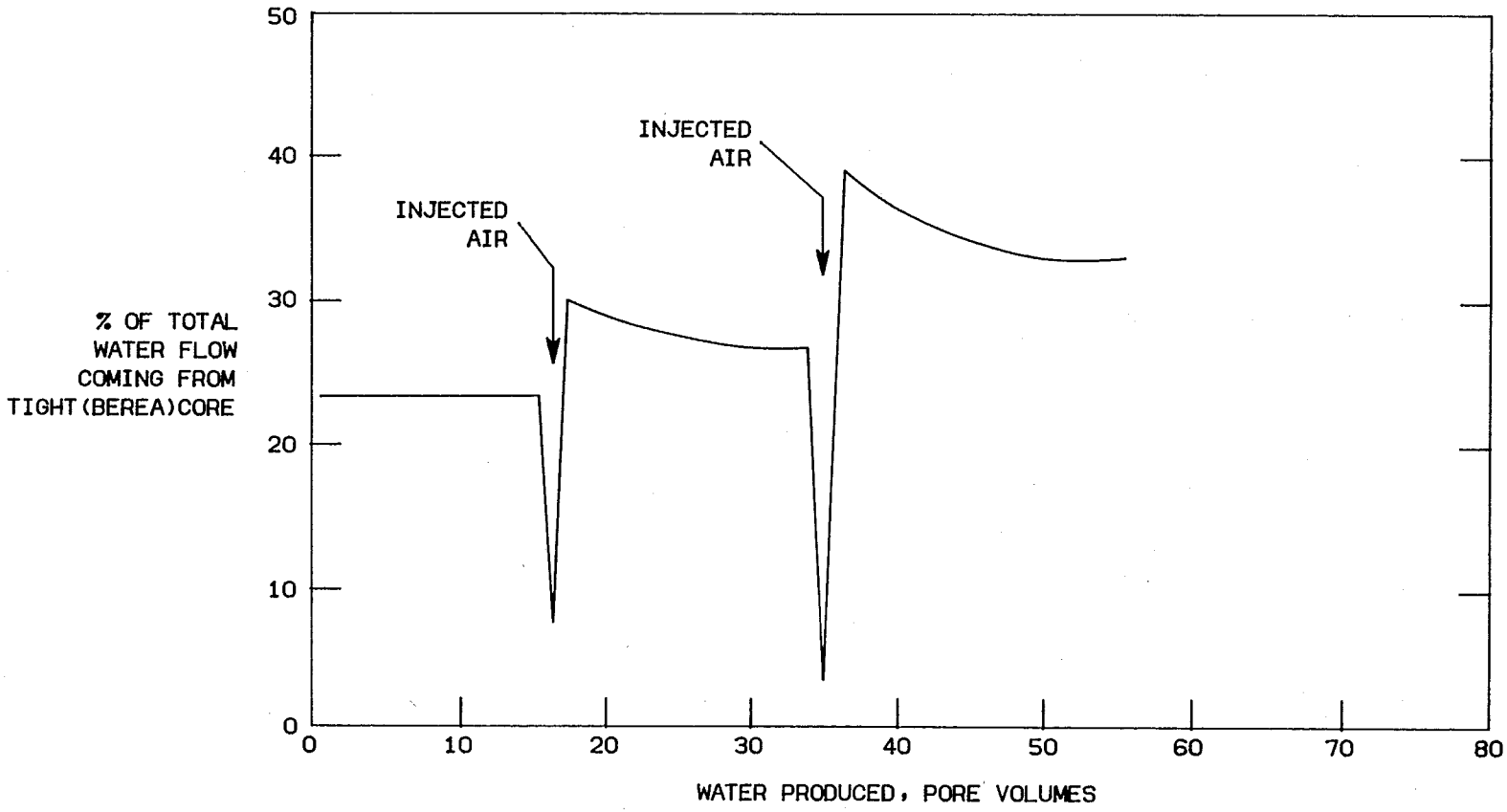
FIG. 2 is a plot of total water flow through a core versus water produced.

In a first test, water was first injected followed by 0.23 pore volumes of air then by a second slug of water followed by 0.26 pore volumes of air and finally, by a third slug of water. The results of this run are plotted as FIG. 2 of the drawings in terms of the percent of the total water flow coming from the tight (Berea) core versus the total amount of water produced from both cores expressed in pore volumes. It is obvious from FIG. 2 that by injecting small slugs of air between the slugs of water, the volume of water flowing through the less permeable core was increased.

Figure 3:
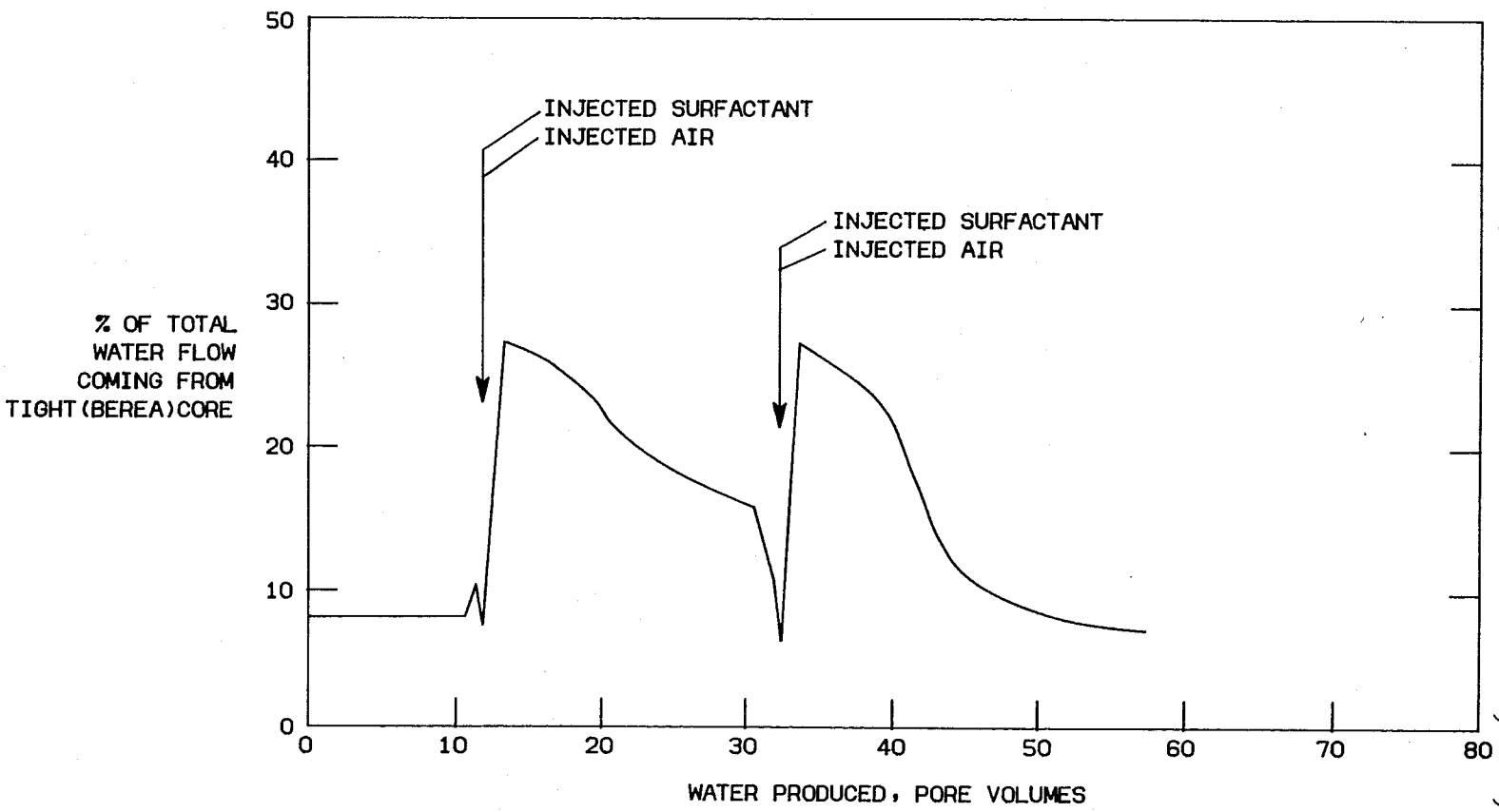
FIG. 3 is a plot of total water flow through a core versus water produced when operating in accordance with one aspect of the present invention.

In a second experiment, both air and surfactant were used. Specifically a first slug of water was injected, followed by 0.46 pore volumes of air then 0.85 pore volumes of Igepal, then a second slug of water followed 0.46 pore volumes of air and 0.59 pore volumes of Igepal, and finally followed by a third slug of water. The results of this test are shown in FIG. 3 of the drawings which is essentially the same plot as that of FIG. 2. It is obvious that the two cores were apparently damaged in cleaning and resaturation between the first experiment and the present experiment. Thus, the results between the two experiments are not directly comparable. However, the results do show improved flow of water through the tighter Berea core when utilizing both slugs of air and a surfactant. This experiment also indicates that more than one sequence of fluids can be utilized to increase the flow in the tighter core.

Figure 4:
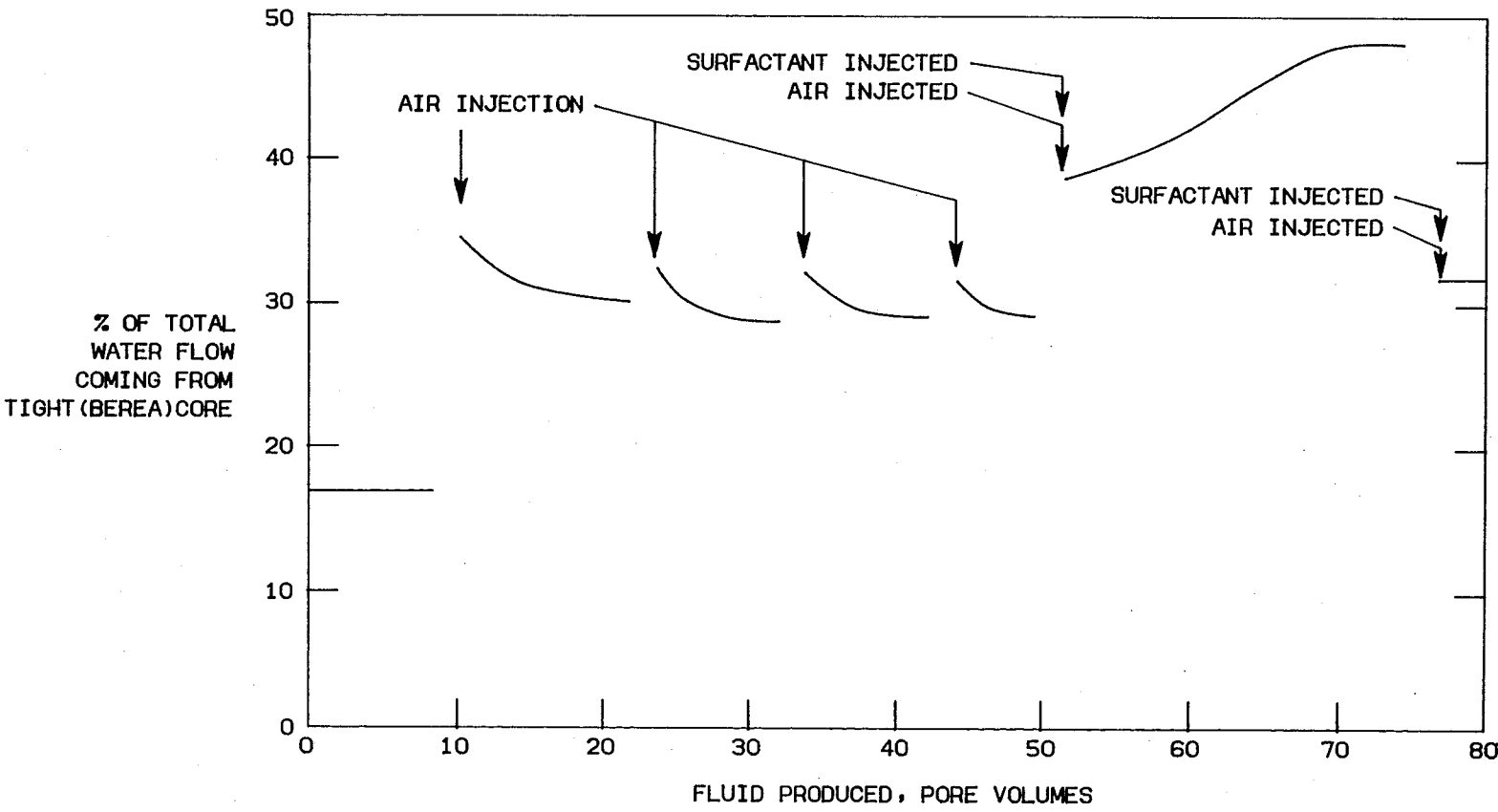
FIG. 4 is a plot of total water flow through a core versus water produced in accordance with another aspect of the present invention.

A third experiment was carried out in which several sequences of water and air were followed by sequences of water and air surfactant. The results of this experiment are illustrated in FIG. 4. It is to be observed from FIG. 4 that air alone increased the flow through the tighter Berea core from about 16.7% to about 29%. However, injection of a surfactant ahead of the air resulted in up to 48% of the injected water going into the tighter core. Specifically, with the air-surfactant slug, the flow into the tighter core ranged from about 38% to 48% when an injection of about 24 volumes of fluid was utilized.

Figure 5:
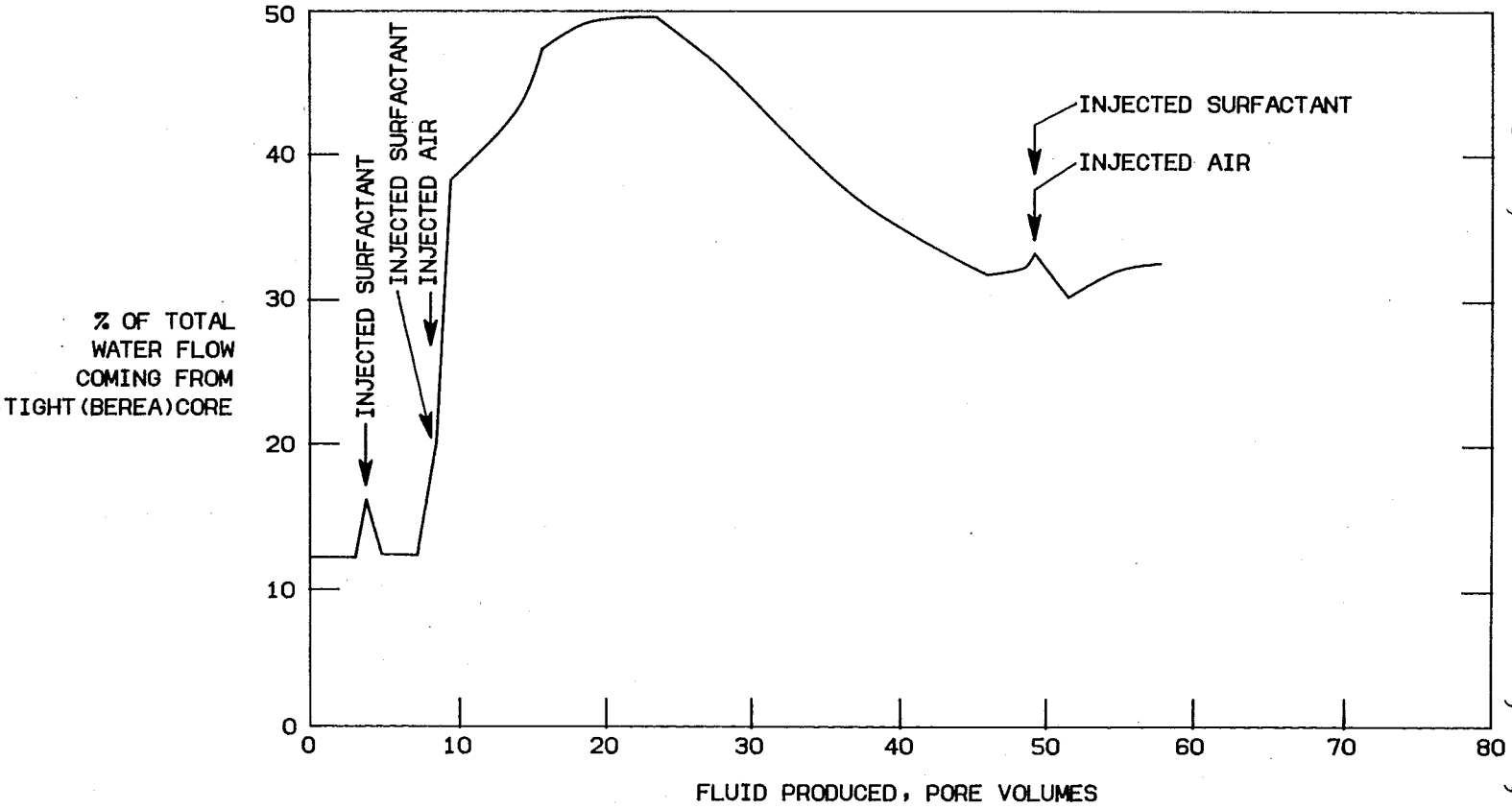
FIG. 5 is a plot of total water flow versus fluid produced in accordance with another aspect of the present invention.

Another experiment was carried out in which surfactants alone were injected and it was found that surfactant alone did not significantly increase the flow of water into the tighter core. This experiment also suggests that the use of surfactant-air slugs give greater diversion of the fluid into the tighter core than can be generally obtained with air alone. This is illustrated by the plot of this run, as shown in FIG. 5.

Figure 6:
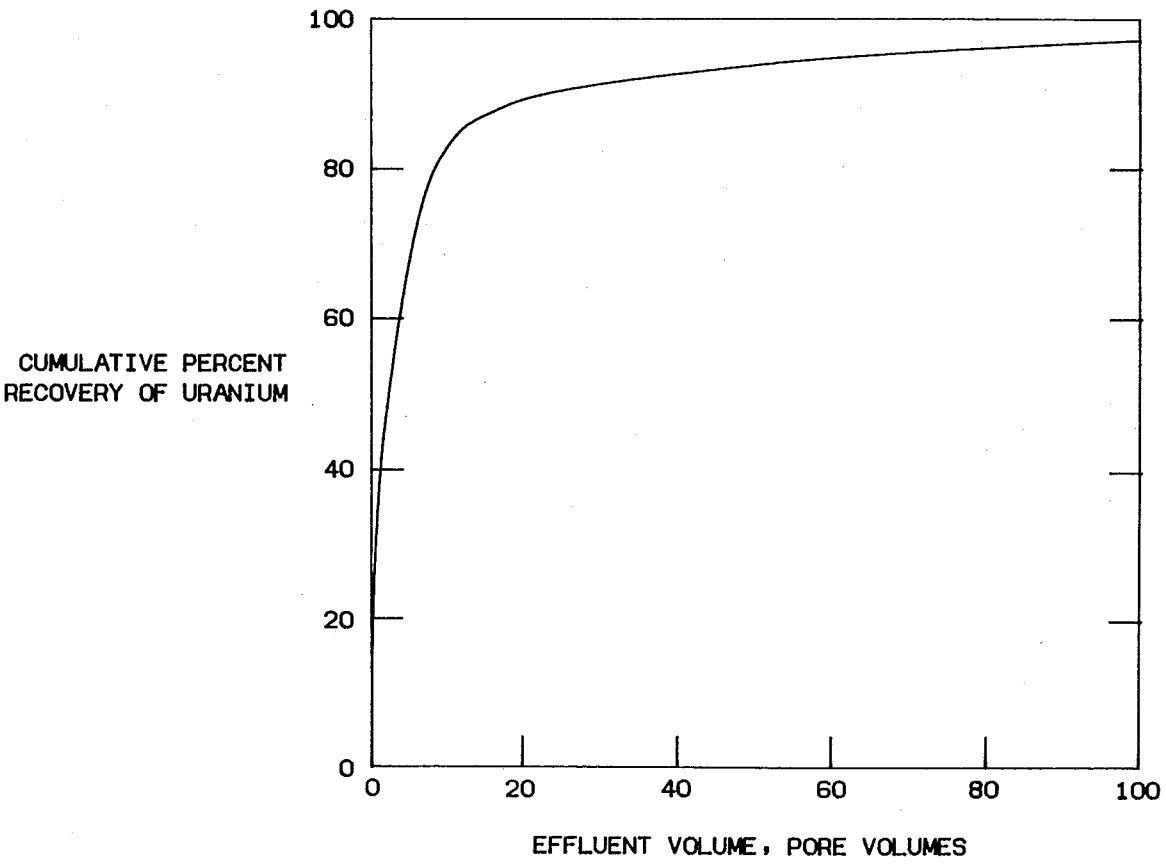
FIG. 6 is a plot of percent recovery of uranium from a uranium-containing core versus effluent volume from the core.

The results of the previous experiments projected for a hypothetical reservoir illustrates the usefulness of the present invention. It was assumed that the reservoir consisted of two layers of equal thickness and aereal extent. It was also assumed that these layers are separated by a very thin layer void of uranium. It was also assumed that the uranium content of the formation was the same as that shown by the results plotted in FIG. 6 of the drawings which is a plot of cumulative uranium recovery versus effluent volume for a particular core containing uranium. It was assumed that leaching solution was a 1% sulfuric acid solution containing 0.5% sodium chlorate as an oxidant. It was also assumed that the leaching rate for the reservoir was the same as that shown in FIG. 6. Of course, it is also assumed that no uranium will be leached from the separating layer since it is assumed to be devoid of uranium. Therefore, the leaching rates for the hypothetical reservoir are calculated. In the base case, no air or surfactant-air was injected but simply the leach solution. In this case, 16.7% of the total fluid injected would go into the uranium bearing layer (see experiment 3). The volume required to produce a certain cumulative percent of uranium, for example, 60%, would be equal to the volume shown in FIG. 6 divided by 0.167. The base case curve thus calculated is plotted in FIG. 7. Similarly, the case in which air alone was injected as a slug between slugs of leach solution was calculated, assuming that the tight core leach solution intake would be about 29%, as shown from experiment 3. This has also been plotted in FIG. 7 as the air injection case. Finally, it was assumed from the results of experiment 3 that when slugs of both air and surfactant were injected between leach solution slugs, an average of about 43% of the leach solution would flow through a uranium containing reservoir. A curve was then calculated on this basis and is plotted as the surfactant-air injection case in FIG. 7.

Figure 7:
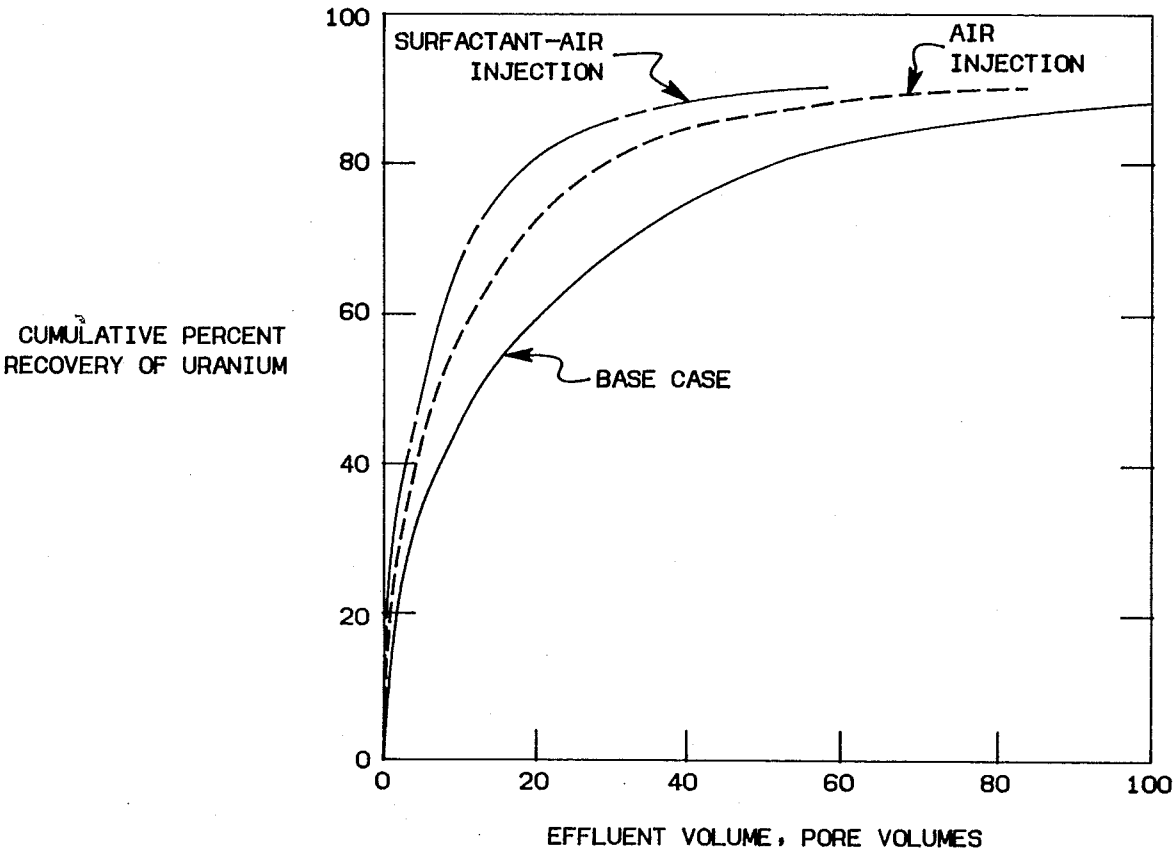
FIG. 7 is a plot of cumulative recovery of uranium versus effluent volume in a hypothetical reservoir for a prior art operation and two aspects of the present invention.

It is obvious from FIG. 7 that the practice of the present invention results in reducing the volume of leach solution required by up to two to three times, assuming that the maximum leach rate is being used in all cases, the end result is that the leaching time is also cut by up to two to three times. It should also be noted that a certain $U_3O_8$ concentration in the effluent represents the economic cutoff of a recovery project. Consequently, it can be shown that the injection of all the slugs of air or surfactant-air will both result in more total $U_3O_8$ being produced at the cutoff than in the base case. The extra amount produced will depend on the economic cutoff concentration and of course reservoir conditions.

While specific materials, techniques and modes of operation are referred to in the previous description, it is to be understood that such specific recitals are by way of illustration and to set forth the best mode of operation in accordance with the present invention and are not to be considered limiting.

That which is claimed:

1. A method for the in situ recovery of mineral values from a heterogeneous subsurface earth formation containing mineral values, which formation comprises zones of both high and low permeability, comprising:

(a) injecting a plurality of separate slugs of a leach solution, adapted to solvate said mineral values, into at least one injection well in communication with all zones of said formation;

(b) injecting a slug of gas, which is essentially insoluble in said leach solution, between each two successive slugs of leach solution;

(c) injecting a mobility modifier, adapted to decrease the mobility of said leach solution, at at least one of the trailing end and the leading end of each slug of said leach solution which is in contact with a slug of said gas; and (d) withdrawing pregnant leach solution, containing significant amounts of solvated mineral values, from at least one production well in communication with all zones of said formation.

2. A method in accordance with claim 1 wherein the mobility modifier is essentially nonreactive with components of the leach solution.

3. A method in accordance with claim 1 wherein the mobility modifier is a surfactant.

4. A method in accordance with claim 3 wherein the surfactant is a nonionic surfactant.

* * * * *